United States Patent [19]

Ditchfield

[11] Patent Number: 4,667,824

[45] Date of Patent: May 26, 1987

[54] COIL PACKAGE

[75] Inventor: Neville J. Ditchfield, Vicars Cross, England

[73] Assignee: BICC Public Limited Company, London, England

[21] Appl. No.: 761,574

[22] Filed: Jul. 31, 1985

[30] Foreign Application Priority Data

Aug. 2, 1984 [GB] United Kingdom ..... 8419712

[51] Int. Cl.[4] ..... B65D 85/04

[52] U.S. Cl. ..... 206/408; 206/225; 206/397; 206/414; 206/415; 206/416; 242/146; 242/170

[58] Field of Search ..... 206/225, 303, 316, 389, 206/391, 392, 397, 408, 394, 395, 396, 401, 402, 409, 414, 415, 416; 242/159, 146, 163, 170

[56] References Cited

U.S. PATENT DOCUMENTS

| | | | |
|---|---|---|---|
| 485,712 | 11/1892 | Rogers | 206/397 |
| 1,260,491 | 3/1918 | Weaver | 206/415 |
| 1,691,995 | 11/1928 | Saulter | 206/408 |
| 1,908,026 | 5/1933 | Kneen | 206/402 |
| 2,101,355 | 12/1937 | Wonder | 206/303 |
| 2,180,858 | 11/1939 | Bedell | 206/408 |
| 2,527,401 | 10/1950 | Daoust | 206/408 |
| 2,554,615 | 5/1951 | Dahle | 242/146 |
| 2,771,849 | 11/1956 | Galbreath | 242/159 |
| 2,929,496 | 3/1960 | Muehlebach et al. | 206/408 |
| 2,935,190 | 5/1960 | Braun | 206/408 |
| 3,587,840 | 6/1971 | Holtberg | 206/408 |
| 3,680,810 | 8/1972 | Jarmalow | 206/408 |
| 3,861,560 | 1/1975 | Entwistle et al. | 206/409 |
| 4,168,778 | 9/1979 | Buxton | 206/397 |
| 4,176,744 | 12/1979 | Borzak | 206/408 |
| 4,369,881 | 1/1983 | Ditchfield | 206/397 |
| 4,474,900 | 10/1969 | Clark et al. | 206/586 |

FOREIGN PATENT DOCUMENTS

| | | | |
|---|---|---|---|
| 730321 | 4/1932 | France | 206/402 |
| 350792 | 6/1931 | United Kingdom | 206/402 |
| 357343 | 9/1931 | United Kingdom | 206/402 |

*Primary Examiner*—Joseph Man-Fu Moy
*Assistant Examiner*—David T. Fidei
*Attorney, Agent, or Firm*—Buell, Ziesenheim, Beck & Alstadt

[57] ABSTRACT

An improved coil package comprises a closable carton formed from a folded blank of cardboard and having a pair of oppositely disposed major side walls, each of which has an aperture in axial alignment with the aperture of the other major side wall and, removably housed in the carton, a reel on which is carried a coil of wire. The flanges of the reel have apertures of diameters less than the apertures in the major side walls of the carton and end parts of a rigid hollow hub formed of a transversely folded metal strip protrude from the reel flanges and are so rolled radially outwardly that their extreme edges bite into the outer faces of the reel flanges, no portions of the rolled over end parts of the hub protruding beyond the planes containing the outer faces of the major side walls.

13 Claims, 6 Drawing Figures

Fig. 5.
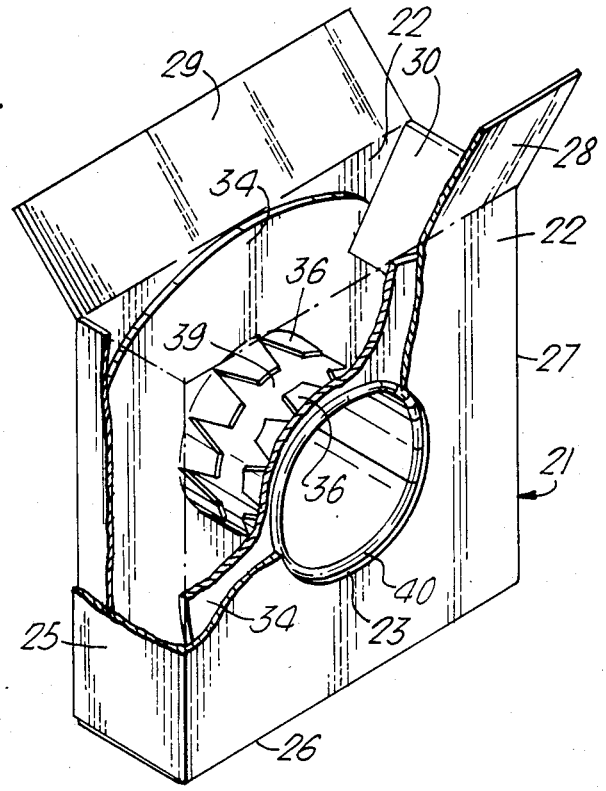
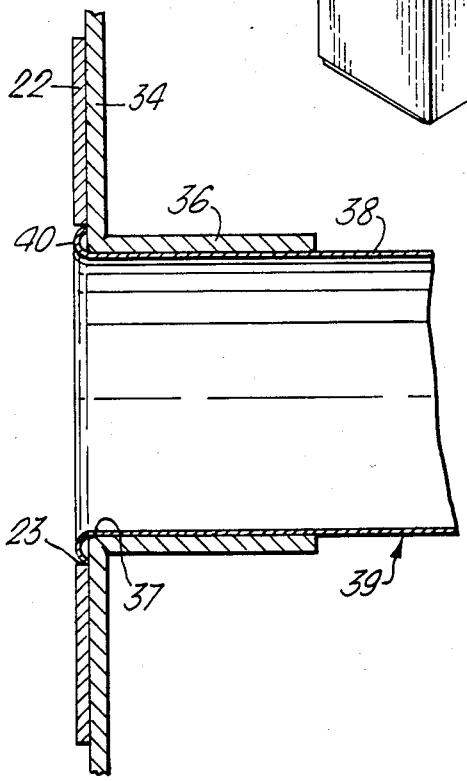
Fig. 6.

COIL PACKAGE

This invention relates to the packaging of wire or cable and more particularly to the packaging of coils of bare or insulated electric wire or cable, for example wire or cable of the kind used in house wiring systems, all such bare and insulated wire and cable hereinafter, for convenience, being included in the generic term "wire".

In the specification of co-pending U.S. patent application Ser. No. 559871 of Neville J. Ditchfield and Clive Rowland Edward Carroll there is described and claimed an improved coil package which serves the dual purposes of a wire carton and a reel and which is simple and inexpensive to manufacture. This improved coil package comprises a closable carton which is formed from at least one folded blank of cardboard or plastics material and which has a pair of oppositely disposed major side walls, each of which major side walls has an aperture in substantially axial alignment with the aperture of the other major side wall; a pair of separately formed substantially flat reel flanges, each of which reel flanges is in inter-facial contact with or is adjacent, to the inner face of one of the major side walls and each of which reel flanges has an aperture in substantially axial alignment with the apertures of the major side walls; a coil of wire positioned between and bounding the apertures in the reel flanges; and, extending between parts of the reel flanges bounding said aligned apertures, a substantially rigid hollow hub, each reel flange being restrained against movement in a direction away from its adjacent major side wall. The reel flanges constitute component parts of the coil package and serve to strengthen its major side walls and, as a consequence, the improved coil package has the important advantage that the carton can be formed of a cardboard or plastics material of a thickness such that it can be readily folded.

In the preferred embodiment of the invention of the aforesaid co-pending U.S. patent application, each reel flange is restrained against movement in a direction away from the associated major side wall of the carton by securing the flange to the rigid hollow hub and, preferably, the rigid hollow hub is secured to the major side walls in such a way that each reel flange is locked with respect to the rigid hollow hub and is detachably secured to the adjacent major side wall.

It is an object of the present invention to provide a modified coil package in accordance with the invention of the aforesaid co-pending U.S. patent application, which modified coil package, in addition to serving the dual purposes of a wire carton and a reel and being simple and inexpensive to manufacture, eliminates the necessity of detaching the reel from the major side walls of the carton.

According to the invention the modified coil package comprises a closable carton which is formed from at least one folded blank of cardboard or plastics material and which has a pair of oppositely disposed major side walls, each of which major side walls has an aperture in substantially axial alignment with the aperture of the other major side wall; a pair of separately formed substantially flat reel flanges, each of which reel flanges is in inter-facial contact with or is adjacent to the inner face of one of the major side walls and each of which reel flanges has an aperture in substantially axial alignment with and having a radius less than the radii of the apertures of the major side walls; a coil of wire positioned between and bounding the apertures in the reel flanges; and, extending between parts of the reel flanges bounding said aligned apertures, a substantially rigid hollow hub formed by a transversely folded strip of metal or metal alloy, having end parts so distorted that their extreme edges are secured to outer faces of the reel flanges to form a reel whose reel flanges are restrained against movement in a direction away from the adjacent major side walls of the carton and which can be readily removed from the coil package.

Movement of each reel flange in a direction away from its adjacent major side wall also be restrained, at least in part, by the coil of wire and, additionally, by the tendency of the transversely folded strip of metal or metal alloy to expand radially outwardly to bear against the radially inner surface of each flange bounding its aperture. Further restraint against movement of each flange in a direction away from its associated major side wall is provided by a tendency for the end portion of the transversely folded strip of metal or metal alloy overlying the other end portion of the strip to bow radially outwardly over a part of the axial length of the rigid hub intermediate of the reel flanges.

Preferably, the aperture in each reel flange is formed from an area of weakness defined by a plurality of radially extending petals which are folded inwardly of the flange and overlie the circumferential outer surface of the rigid hollow hub. The inwardly folded petals from the apertures in the reel flanges serve to prevent the edge of the overlapping end portion of the transversely folded metal strip from damaging the inner layer or layers of wire of the coil.

Preferably, also, no portions of the rolled over or otherwise distorted end parts of the hub protrude beyond the planes containing the outer faces of the major side walls of the carton so that modified coil packages can be readily stacked one on top of another.

To provide for ready removal of the reel from the carton, the carton may have, at one of its ends and integral with at least one of the major side walls, a foldable flap by which the carton can be opened and closed. Alternatively, the carton may have, extending diametrically across each major side wall and across diametrically opposed parts of the outer peripheral wall, a perforated boundary line by means of which the carton can be readily separated into two parts which, when moved apart in a direction transverse to the axis of the reel, permit removal of the reel and which can be reassembled about the reel.

The major side walls of the carton preferably are each of substantially rectangular shape and have minor side walls integral with three pairs of oppositely disposed side edges of the major side walls and a minor side wall integral with one or each side edge of a fourth pair of oppositely disposed side edges of the major side walls, the latter minor side wall or walls constituting a foldable flap or flaps.

Each reel flange may be of circular or non-circular shape and, in a preferred embodiment, each flange is of a shape approximating to a curvilinear square.

Preferably, the coil or wire is so positioned between the reel flanges that the radially outer end of the coiled wire is adjacent the folded flap or flaps of the carton.

The method also includes a modified method of assembling a coil package which comprises folding at least one blank of cardboard or plastics material to form a closable carton comprising a pair of oppositely disposed major side walls each having an aperture in substantially axial alignment with the aperture of the other major side wall and positioning in inter-facial contact with and adjacent to the inner faces of the major side walls a pair of separately formed substantially flat reel flanges, each having a substantially central aperture, or area of weakness for forming an aperture, of a radius less than the radii of the apertures in the major side walls, in such a way that the apertures of the flanges and of the major side walls are in substantially axial alignment; introducing a coil of wire into the carton until it is positioned between and bounds the apertures in the reel flanges; introducing a transversely folded strip of metal or metal alloy constituting a substantially rigid hollow hub through the aperture in one major side wall, through the aperture in the adjacent reel flange, through the coil of wire and through the aperture in the other reel flange; and rolling end parts of the rigid hollow hub protruding through the apertures in the reel flanges radially outwardly or otherwise so distorting said end parts that their extreme edges bite into or are otherwise secured to the reel flanges.

To ensure that the reel flanges do not impede introduction of a coil of wire into the carton during assembly of the coil package, preferably the carton has integral with end edges of oppositely disposed minor side walls of the carton, ears which can be so folded inwardly as to extend between and bear against the reel flanges to hold them apart and so permit introduction of a coil of wire into the carton prior to introduction of the rigid hollow hub through the aligned apertures.

Accordingly, the invention also includes a method of assembling a modified coil package as hereinbefore described, which method comprises folding at least one blank of cardboard or plastics material to form a closable carton comprising a pair of oppositely disposed major side walls each having an aperture in substantially axial alignment with the aperture of the other major side wall, minor side walls integral with pairs of oppositely disposed side edges of the major side walls and a minor side wall integral with at least one side edge of another pair of oppositely disposed side edges of the major side walls, said latter minor side wall constituting a foldable flap for closing the carton, end edges of one pair of oppositely disposed minor side walls having ears integral with said minor side walls; introducing into the carton a pair of separately formed substantially flat reel flanges, each having a substantially central aperture, or an area of weakness for forming an aperture, of a radius less than the radii of the apertures in the major side walls, in such a way that each is in inter-facial contact with or is adjacent to the inner face of one of the major side walls with its aperture in substantially axial alignment with the aperture of said major side wall; folding said ears inwardly to extend between and bear against the reel flanges to hold the flanges apart; introducing a coil of wire into the carton until it is positioned between and bounds the apertures in the reel flanges; introducing a transversely folded strip of metal or metal alloy forming a substantially rigid hollow hub through the aperture in one major side wall, through the aperture in the adjacent reel flange, through the coil of wire and through the aperture of the other reel flange; and rolling end parts of the rigid hollow hub protruding through the apertures in the reel flanges radially outwardly so that their extreme edges bite into the outer faces of the reel flanges.

In the preferred method of assembly, the area of weakness in each reel flange is defined by a plurality of radially extending petals which are folded inwardly of the carton and which will overlie the outer circumferential surface of the rigid hollow hub.

The invention is further illustrated by a description, by way of example, of two preferred forms of modified coil package with reference to the accompanying drawings, in which:

FIG. 5 is an isometric view of a later stage in the manufacture of the second form of modified coil package from which, for clarity, the coil of wire has been omitted, and FIG. 6 is a fragmental secional side view of the partly assembled second form of modified coil package shown in FIG. 5.

Figure 1:
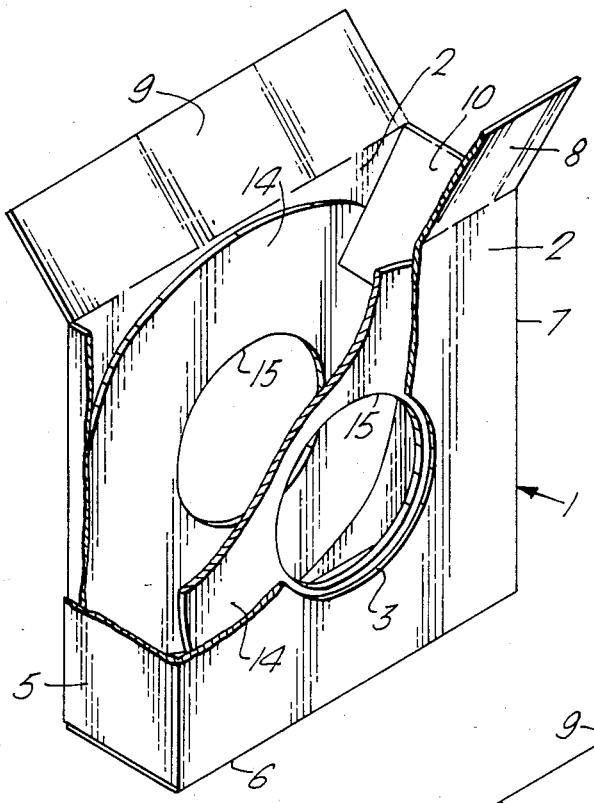
FIG. 1 is an isometric view of a stage in the manufacture of a first form of modified coil package.

Referring to FIG. 1, in the method of assembling the first preferred form of modified coil package a blank of cardboard is folded to form a closable carton 1 comprising a pair of oppositely disposed major side walls 2 each of substantially square shape and each having a central aperture 3 of circular shape. Minor side walls 5, 6 and 7 are integral with three pairs of oppositely disposed side edges of the major side walls 2 and each side edge of the fourth pair of oppositely disposed side edges of the major side walls has an integral foldable flap 8, 9 for closing the carton. End edges of oppositely disposed minor side walls 5, 7 have integral with these walls foldable ears 10.

A pair of separately formed flat reel flanges 14 each of a shape approximating to a curviliniear square and each having a central aperture 15 of circular shape and of a diameter less than the diameter of the apertures 3 in the major side walls 2 is introduced into the carton 1 in such a way that each reel flange is in inter-facial contact with the inner face of one of the major side walls 2 with its aperture in axial alignment with the aperture of the major side wall. Ears 10 are then folded inwardly and reciprocating deflecting means, which are introduced through holes (not shown) in the minor side walls 5, 7, cause the ears to extend between and bear against the reel flanges 14 to hold them apart and in inter-facial contact with the inner faces of the major side walls 2. A coil of wire (not shown) is then introduced into the carton through the upper open end until it is positioned between and bounds the apertures 15 in the reel flanges 14.

Figure 2:
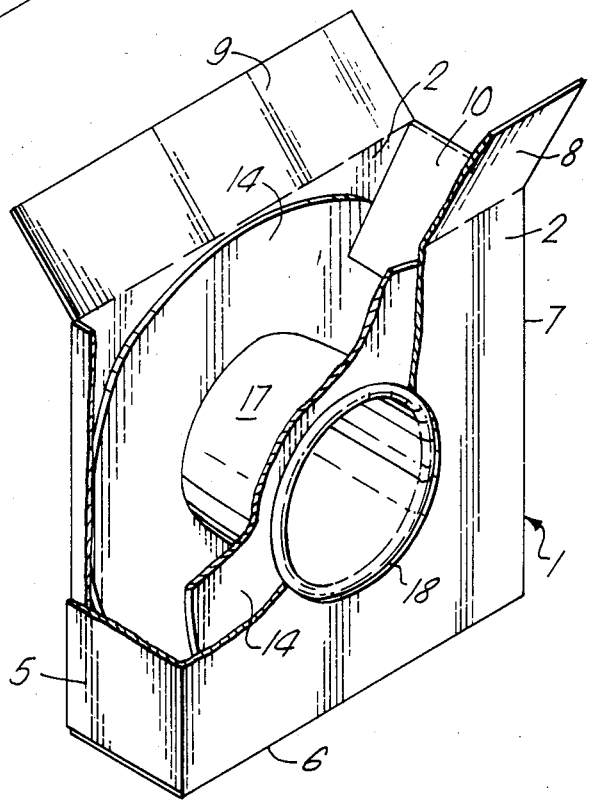
FIG. 2 is an isometric view of a later stage in the manufacture of said first form of modified coil package from which, for clarity, the coil of wire has been omitted.
Figure 3:
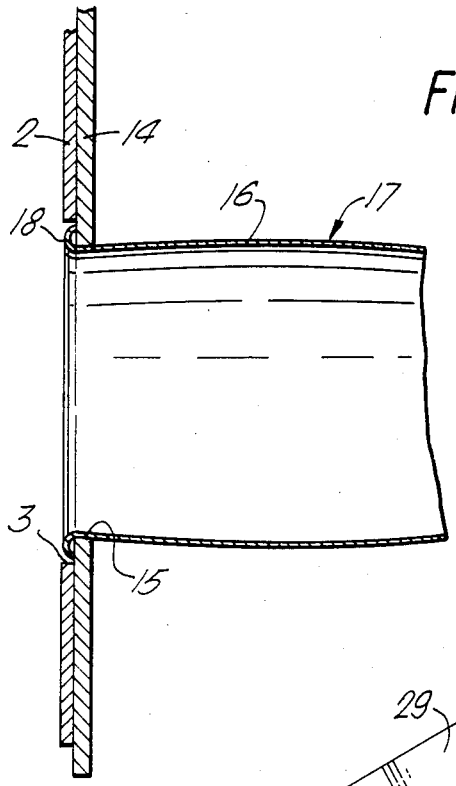
FIG. 3 is a fragmental sectional side view of the partly assembled first form of modified coil package shown in FIG. 2.

Referring to FIGS. 2 and 3 in which, for clarity, the coil of wire is omitted, a metal strip 16 transversely folded into tubular form with its end portions overlapping is introduced through the aperture 3 in one major side wall 2, through the aperture 15 in the adjacent reel flange 14, through the coil of wire, and through the aperture 15 of the other reel flange 14 and the folded strip is expanded radially outwardly to bear against the radially inner surface of each flange bounding its aperture and so form a rigid hollow hub 17. End parts 18 of the rigid holow hub 17 protruding from the apertures 15 in the reel flanges 14 are then rolled radially outwardly to such an extent that the extreme edges of the hub bite into the outer faces of the reel flanges, no portions of the rolled over end parts of the hub protruding beyond the planes containing the outer faces of the major side walls 2. The carton 1 is then closed by folding flaps 8, 9 one on top of the other and sealing the carton by adhesive tape.

Assembly of the first preferred form of modified coil package as above described is effected automatically by means of machines associated with and positioned adjacent to a coil winding machine.

Figure 4:
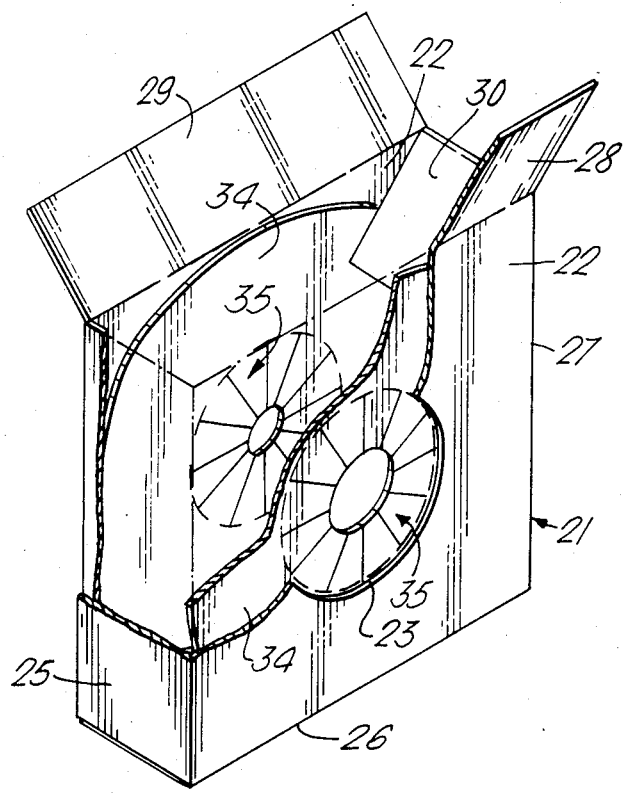
FIG. 4 is an isometric view of a stage in the manufacture of a second form of modified coil package.

Referring to FIG. 4, in the method of assembling the second preferred form of modified coil package a blank of cardboard is folded to form a closable carton 21 comprising a pair of oppositely disposed major side walls 22 each of substantially square shape and each having a central aperture 23 of circular shape in axial alignment with the central aperture of the other major side wall. Minor side walls 25, 26 and 27 are integral with three pairs of oppositely disposed side edges of the major side walls 22 and each side edge of the fourth pair of oppositely disposed edges of the major side walls has an integral foldable flap 28, 29 for closing the carton. End edges of oppositely disposed minor side walls 25, 27 have integral with these walls foldable ears 30.

A pair of separately formed flat reel flanges 34 each of a shape approximating to a curvilinear square and each having a central area of weakness 35 is introduced into the carton 21 in such a way that each reel flange is in inter-facial contact with the inner face of one of the major side walls 22 with its central area of weakness in axial alignment with the aperture 23 of the major side wall. Ears 30 are then folded inwardly and reciprocating deflecting means, which are introduced through holes (not shown) in the minor side walls 25, 27, cause the ears to extend between the ear against the reel flanges 34 to hold them apart and in inter-facial contact with the inner faces of the major side walls 22. A coil of wire (not shown) is then introduced into the carton through the upper open end until it is positioned between and bounds the central areas of weakness 35 in the reel flanges 34.

Referring to FIGS. 5 and 6 in which, for clarity, the coil of wire is omitted, petals 36 of each flange 34 are then folded inwardly of the carton 1 to form a central aperture 37 of circular shape having a diameter less than the diameters of the apertures 23 in the major side walls 22. A metal strip 38 transversely folded into tubular form with its end portions overlapping is introduced through the aperture 23 in one major side wall 22, through the resulting aperture 37 in the adjacent reel flange 34, through the coil of wire and through the resulting aperture 37 of the other reel flange 34 and the folded strip is expanded radially outwardly to bear against the undersurfaces of the petals 36 to form a rigid hollow hub 39. End parts 40 of the rigid hollow hub 39 protruding from the apertures 37 in the flanges 34 are then rolled radially outwardly to such an extent that the extreme edges of the hub bite into the outer faces of the flanges, no portions of the rolled over end parts of the hub protruding beyond the planes containing the outer faces of the major side walls 22. The carton 21 is then closed by folding flaps 28, 29 one on top of the other and sealing the carton by adhesive tape.

As in the case of the first preferred form of modified coil package illustrated in FIGS. 1 to 3, assembly of the second preferred form of modified coil package is effected automatically by means of machines associated with and positioned adjacent to a coil winding machine.

What I claim as my invention is:

1. A coil package comprising a closable carton which is formed from at least one folded blank of cardboard or plastics material and which has a pair of oppositely disposed major side walls, each of which major side walls has an aperture in substantially axial alignment with the aperture of the other major side wall; a pair of separately formed substantially flat reel flanges, each of which reel flanges is adjacent to the inner face of one of the major side walls and each of which reel flanges has an aperture in substantially axial alignment with and has a radius less than the radii of the apertures of the major side walls; a coil of wire positioned between and bounding the apertures in the reel flanges; and, extending between parts of the reel flanges bounding said aligned apertures, a substantially rigid hub formed by a transversely folded strip of metal or metal alloy having end parts so distorted that their extreme edges are secured to outer faces of the reel flanges to form a reel whose reel flanges are restrained against movement in a direction away from the adjacent major side walls of the carton and which can be readily removed from the coil package.

2. A coil package as claimed in claim 1, wherein end parts of the hub are so rolled radially outwardly that their extreme edges bite into outer faces of the reel flanges.

3. A coil package as claimed in claim 1 or 2, wherein the aperture in each reel flange is formed from an area of weakness defined by a plurality of radially extending petals which are folded inwardly of the flange and overlie the circumferential outer surface of the rigid hollow hub.

4. A coil package as claimed in claim 1 or 2, wherein no portions of the rolled over or otherwise distorted end parts of the hub protrude beyond the planes containing the outer faces of the major side walls of the carton.

5. A coil package as claimed in claim 1, wherein the carton has, at one of its ends and integral with at least one of the major side walls, a foldable flap by which the carton can be opened and closed.

6. A coil package as claimed in claim 5, wherein the carton has, integral with each of a pair of oppositely disposed side edges of the major side walls, a foldable flap, the flaps being foldable one on top of the other and having inter-engaging means by which the carton can be temporarily closed.

7. A coil package as claimed in claim 5, wherein the major side walls of the carton are each of substantially rectangular shape and have minor side walls integral with three pairs of oppositely disposed side edges of the major side walls and a minor side wall integral with at least one side edge of a fourth pair of oppositely disposed side edges of the major side walls, the latter minor side wall constituting said foldable flap.

8. A coil package as claimed in claim 7, wherein the carton has integral with end edges of oppositely disposed minor side walls of the carton, ears which can be so folded inwardly as to extend between and bear against the reel flanges.

9. A coil package as claimed in claim 5, wherein the coil of wire is so positioned between the reel flanges that the radially outer end of the coiled wire is adjacent the foldable flap or flaps of the carton.

10. A coil package as claimed in claim 1 or 2, wherein each flange is of a shape approximating to a curvilinear square.

11. A method of assembling a coil package which comprises folding at least one blank of cardboard or plastics material to form a closable carton comprising a pair of oppositely disposed major side walls each having an aperture in substantially axial alignment with the aperture of the other major side wall and positioning in inter-facial contact with and adjacent to the inner faces of the major side walls a pair of separately formed substantially flat reel flanges, each having a substantially central aperture of a radius less than the radii of the apertures in the major side walls, in such a way that the aperture of the flanges and of the major side walls are in substantially axial alignment; introducing a coil of wire into the carton until it is positioned between and bounds the apertures in the reel flanges; introducing a transversely folded strip of metal or metal alloy constituting a substantially rigid hollow hub through the aperture in one major side wall, through the aperture in the adjacent reel flange, through the coil of wire and through the aperture in the other reel flange; and rolling end parts of the rigid hollow hub protruding through the apertures in the reel flanges radially outwardly so that their extreme edges bite into the outer faces of the reel flanges.

12. A method of assembling a coil package which comprises folding at least one blank of carboard or plastics material to form a closable carton comprising a pair of oppositely disposed major side walls each having an aperture in substantially axial alignment with the aperture of the other major side wall, minor side walls integral with pairs of oppositely disposed side edges of the major side walls and a minor side wall integral with at least one side edge of another pair of oppositely disposed side edges of the major side walls, said latter minor side wall constituting a foldable flap for closing the carton, end edges of one pair of oppositely disposed minor side walls having ears integral with said minor side walls; introducing into the carton a pair of separately formed substantially flat reel flanges, each having an area of weakness for forming an aperture of a radius less than the radii of the apertures in the major side walls, in such a way that each is adjacent to the inner face of one of the major side walls with its area of weakness in substantially axial alignment with the aperture of said major side wall; forming said aperture in each reel flange; folding said ears inwardly to extend between and bear against the reel flanges to hold the flanges apart; introducing a coil of wire into the carton until it is positioned between and bounds the apertures in the reel flanges; introducing a transversely folded strip of metal or metal alloy forming a substantially rigid hollow hub through the aperture in one major side wall, through the aperture in the adjacent reel flange, through the coil of wire and through the aperture of the other reel flange; and rolling end parts of the rigid hollow hub protruding through the apertures in the reel flanges radially outwardly so that their extreme edges bite into the outer faces of the reel flanges.

13. A method as claimed in claim 12, wherein the area of weakness in each reel flange is defined by a plurality of radially extending petals which are folded inwardly of the carton and which will overlie in the outer circumferential surface of the rigid hollow hub.

* * * * *

UNITED STATES PATENT AND TRADEMARK OFFICE

CERTIFICATE OF CORRECTION

PATENT NO. : 4,667,824

DATED : May 26, 1987

INVENTOR(S) : NEVILLE J. DITCHFIELD

It is certified that error appears in the above-identified patent and that said Letters Patent is hereby corrected as shown below:

Column 2, line 13, after the word wall, insert --will--.

Column 6, line 19, after the word rigid, insert --hollow--.

Signed and Sealed this

Twenty-seventh Day of October, 1987

*Attest:*

DONALD J. QUIGG

*Attesting Officer*

*Commissioner of Patents and Trademarks*